US006418899B1

(12) United States Patent
Bluemel et al.

(10) Patent No.: US 6,418,899 B1
(45) Date of Patent: Jul. 16, 2002

(54) ELECTRIC DRIVE ARRANGEMENT FOR INTERNAL COMBUSTION ENGINES IN MOTOR VEHICLES

(75) Inventors: Roland Bluemel, Plieningen; Hermann Bosch, Amstetten; Anton Heni, Kernen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/549,589

(22) Filed: Apr. 14, 2000

(30) Foreign Application Priority Data

Apr. 23, 1999 (DE) ..... 199 18 513

(51) Int. Cl.[7] ..... F02N 11/04

(52) U.S. Cl. ..... 123/179.3; 123/179.28; 123/179.4

(58) Field of Search ..... 123/179.3, 179.28, 123/179.4; 290/38 R, 38 C, 31, 40 C

(56) References Cited

U.S. PATENT DOCUMENTS

| | | | | |
|---|---|---|---|---|
| 4,576,132 A | * | 3/1986 | Nakajima et al. | 123/438 |
| 5,121,714 A | * | 6/1992 | Susa et al. | 123/411 |
| 5,735,249 A | * | 4/1998 | Parke et al. | 123/491 |
| 6,032,632 A | * | 3/2000 | Bolenz et al. | 123/179.3 |

FOREIGN PATENT DOCUMENTS

| | | |
|---|---|---|
| DE | 3241079 A1 | 7/1983 |
| DE | 197 05 610 | 12/1997 |
| EP | 0403051 | 12/1990 |
| EP | 0406182 B1 | 1/1991 |
| EP | 0 406 182 | 1/1991 |
| EP | 0793013 A1 | 9/1997 |

* cited by examiner

*Primary Examiner*—Tony M. Argenbright
*Assistant Examiner*—Arnold Castro
(74) *Attorney, Agent, or Firm*—Crowell & Moring LLP

(57) ABSTRACT

An electric drive arrangement for internal combustion engines in motor vehicles having an electric starter coupled to the internal combustion engine, and an electric generator drive connected with the internal combustion engine. The arrangement is connected to a supply battery via a semiconductor circuit arrangement, which determines the operation of the generator either in a generator mode or a motor mode. An electronic control device is used for controlling the starting operation of the internal combustion engine as a function of the signal of at least one temperature sensor with the aid of the generator operated as a motor, either alone or together with the starter. This arrangement makes it possible to achieve quicker and more comfortable starting operations in combination with lower pollutant emissions. The starting operations can be carried out reliably even at very low temperatures.

15 Claims, 1 Drawing Sheet

ELECTRIC DRIVE ARRANGEMENT FOR INTERNAL COMBUSTION ENGINES IN MOTOR VEHICLES

BACKGROUND AND SUMMARY OF THE INVENTION

This application claims the priority of German Patent No. 19918513.1, filed Apr. 23, 1999, the disclosure of which is expressly incorporated by reference herein.

The invention relates to an electric drive arrangement for internal combustion engines in motor vehicles having an electric starter coupled to the internal combustion engine, and an electric generator drive connected with the internal combustion engine.

For decades, internal combustion engines in road vehicles have been started by means of an electronic starter which is connected mechanically to the crankshaft of the internal combustion engine via its starter pinion and the ring gear on the flywheel only during the starting phase. Nowadays, all starter motors have the torque characteristic of a series-wound machine, which is characterized essentially by an output torque which falls continuously to zero as the speed increases, beginning with the maximum possible torque at standstill. During the starting operation this characteristic leads to a torque equilibrium between the starter torque and the drag torque of the internal combustion engine at crankshaft speeds of between 80 and 200 rpm, which are sufficient for starting according to the requirements which have applied hitherto. To make these starter motors as small, light and cheap as possible, d.c. machines of series-wound construction or with permanent-magnetic excitation and as large as possible a transmission ratio relative to the crankshaft have been used. A total transmission ratio of the intermediate gear in the starter and the transmission ratio of the starter pinion relative to the crankshaft is about 60:1. This high transmission ratio necessitates an engagement device which establishes a driving connection with the crankshaft only when the starter is actuated and hence protects the starter motor from extreme speeds.

Future exhaust regulations will make the design of the above-described starting system inadequate. The minimum starting speeds hitherto stipulated at the crankshaft lead to high pollutant emissions in the current starting operation and it is known that there is considerable potential for improvement in this area by raising the starting speed to values within the range of the idling speed of the internal combustion engine.

Another disadvantage of current starting systems is that starting operations last a relatively long time and are relatively loud due to the high transmission ratio of the starter relative to the crankshaft and the necessary engagement and disengagement of the starter pinion. This is becoming less and less acceptable to the customer, especially as future operating concepts for vehicles aimed at achieving fleet consumption targets will require a significantly larger number of starting operations. This will result in problems with the life of current starting systems.

European Patent 0 793 013 A1 discloses a starting operation using a belt-driven generator instead of a conventional starter. Problems arise at very low temperatures since the maximum torque of such an arrangement is no longer sufficient to start the engine reliably under such circumstances. Therefore such systems are restricted to internal combustion engines with small displacements, at best. If a design for large internal combustion engines were implemented which also operated reliably at low temperatures, this would lead to unacceptable large, heavy and expensive generators.

European Patent 0 406 182 B1 attempts to solve this problem by using a boost circuit to generate a higher voltage for starting, briefly bringing about higher currents in the generator—operated as a motor—and hence increasing torque. However, this solution has the disadvantage that the belt drive loses adhesion at low temperatures and tends to slip. In addition, the charging time of the starting energy storage is disruptive, thereby rendering it impossible to perform starting operations is rapid succession. The life of such an arrangement is furthermore inadequate for the future concepts, which necessitate a large number of starting operations.

One object of the present invention is an economical electric drive arrangement for internal combustion engines which provides more rapid and more comfortable starting operation, and which also takes place reliably at low temperatures.

In particular, the drive arrangement according to the invention has the advantage that, in combined operation, the driving torques of the generator and the starter are superimposed in an effective manner since the torque of the active generator cuts in precisely when the starter begins to slacken off. The crankshaft of the internal combustion engine is thereby accelerated very rapidly to well beyond the speed that can currently be achieved by a starter, thus ensuring rapid and reliable starting even at low temperatures. In the case of a cold start, a division of tasks occurs between the conventional starter (overcoming the break-away torque) and the generator (increasing the cranking torque in the range of higher crankshaft speeds). Over dimensioning of the generator together with the power electronics and an unwanted intervention in the drive line can be avoided, and a starter, can be used virtually unaltered. The solution according to the invention thus represents an optimum cost solution. At higher outside temperatures and/or with a warm engine, the starting operation can be performed solely with the generator, thereby enabling particularly comfortable starting with particularly little noise. The electronic control device advantageously decides the starting operation mode as a function of at least on temperature sensor.

The semiconductor circuit to accomplish the present invention can advantageously be connected as an inverter for motor operation of the generator, which is designed as an a.c. or d.c. generator, and as a rectifier for generator operation, making it possible to use a single semiconductor circuit for both modes of operation, with a corresponding improvement in efficiency by active rectification in the generator mode.

The decision as to whether the starting operation should be performed solely by means of the generator operated as a motor or by means of this generator in combination with the starter is made in an optimum manner by the electronic control device as a function of the engine-oil temperature and/or the outside temperature and/or the off time of the internal combustion engine. To start the internal combustion engine at low temperature, the generator and the starter can be switched on simultaneously or in succession with or without a time overlap. These variants can, for example, be chosen as alternatives depending on the respective starting parameters.

It is further advantageous that the electronic control device be designed to set a defined angular position of the crankshaft of the internal combustion engine when switching the engine off with the aid of the generator, which is operated as a motor. For this purpose, the generator is, for example, designed as a fully functional four-quadrant positioning drive. This allows the next starting operation to take place from a defined initial position, thereby considerably speeding up the starting operation and considerably reducing pollutant emissions. Moreover, one of the hitherto customary sensors, either the TDC (Top Dead Center) sensor or the camshaft sensor can be omitted. Activating the ignition and/or injection during the starting operation of the internal combustion engine only at speeds close to the starting speed, e.g. at 80% of the starting speed is particularly favourable for low energy consumption and low pollutant emissions.

The electronic control device can also advantageously be used to support deceleration operations of the internal combustion engine by switching on the generator, operated in the generator mode, and/or to assist acceleration operations of the internal combustion engine by switching on the generator, which operated in the motor mode. For example, operation of the generator as a motor can be used to assist driving dynamics while the internal combustion engine is running, i.e. as an intervention of the active generator for the purpose of assistance during all acceleration processes of the internal combustion engine. On the other hand, it is also possible for rotational energy of the internal combustion engine to be recovered when the generator is operated as a generator, especially in overrun and braking mode, with the result that the generator additionally assists the desired deceleration process. This mode selection takes place most efficiently as a function of the speed of the internal combustion engine.

The active generator can also advantageously be involved in synchronizing the engine and gearbox speeds during gear changes in manual gearboxes. The energy which has to be converted in the synchronizer rings of the gearbox to equalize the rotational speeds can be recovered by means of the generator, and, in addition, more rapid gear changes are obtained, possibly even eliminating the need for synchronizer rings and a clutch, given appropriate design. During a prospective gear change, the engine is controlled in such a way with the assistance of the generator that no torque is transmitted in the drive line. The respective gear can then be disengaged. Re-equalization of the speed then takes place with the aid of an electronic accelerator or with the aid of an electronic throttle valve and electronic assistance. When the engine speed has been synchronized with the new gearbox speed, no jerking movement occurs during the new gear engagement.

It is also possible to prevent excessive device belt slip between the internal combustion engine and the generator by switching on generator operation of the generator or motor operation of the generator. Additional torques at the belt drive can thereby be connected and disconnected or compensated for in a manner which spares the belt, thus increasing the life of the drive belt and largely preventing defects.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
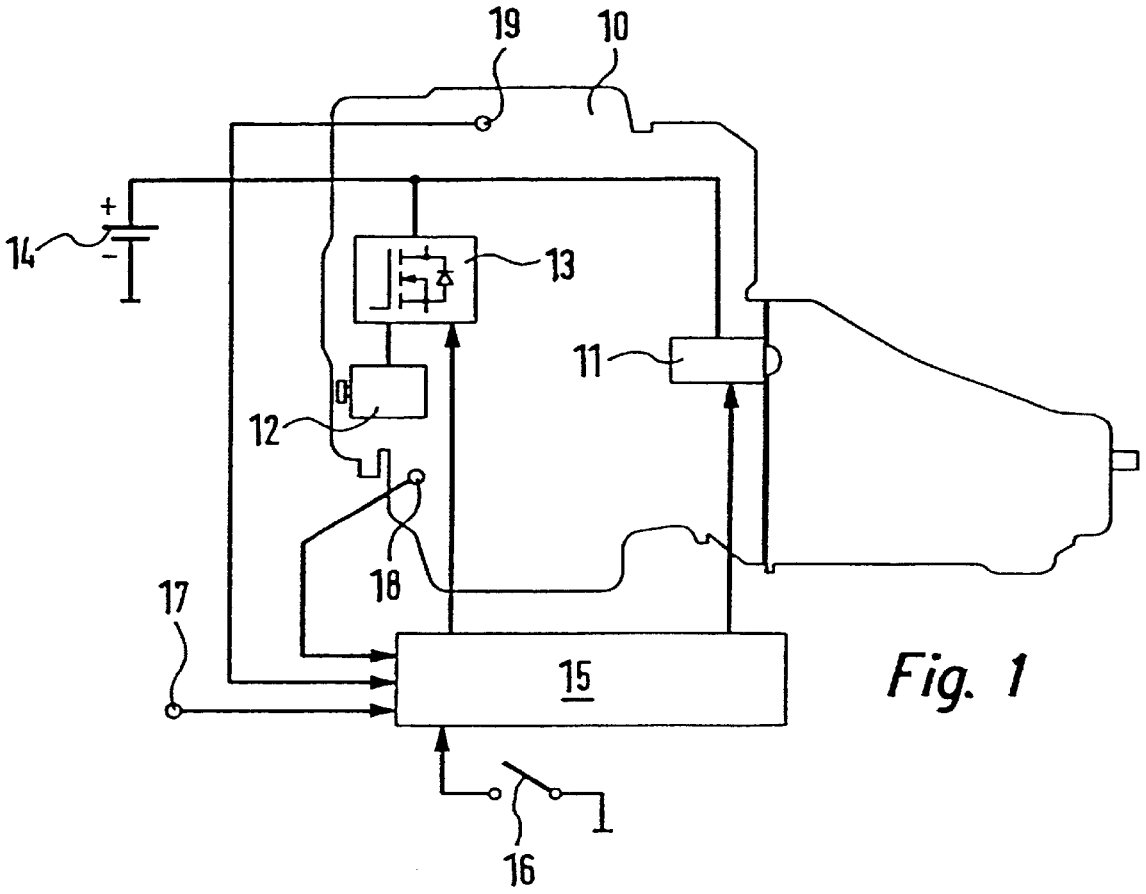
FIG. 1 shows a schematic representation of an internal combustion engine provided with a starter and an electric generator and FIG. 2 shows a diagram to illustrate the mode of operation.

In the exemplary embodiment illustrated in FIG. 1, a schematically represented internal combustion engine 10 of a motor vehicle is provided with a starter 11 and an electric generator 12, the electric generator 12 being coupled to the internal combustion engine 10 by a (not shown) belt drive.

The starter 11 is connected directly to a supply battery 14, and the electric generator 12 is connected to the battery via a semiconductor circuit arrangement 13.

An electronic control device 15 controls the starter 11 and the semiconductor circuit arrangement 13 as a function of sensor signals and start control signals which the control device 15 obtains by means of a starter switch 16, which can be integrated into the ignition lock and/or designed as a separate starter switch. In the exemplary embodiment, the control device 15 is supplied with sensor signals by an external temperature sensor 17, an oil temperature sensor 18 and an intake-pipe pressure sensor 19. However, the control device 15 can, in addition, be supplied with, for example, sensor signals which are dependent on the battery load state, the battery voltage, the current of the battery and the on-board electrical system, the engine speed, pedal positions or parameter switches.

Depending on the operating condition, the semiconductor circuit arrangement 13 receives control signals, from the control device 15, for motor (active) or generator operation of the generator 12. For generator operation, the semiconductor switch arrangement 13 is connected as a rectifier or rectifier bridge while, for motor operation, the switch is connected as an inverter for the generator 12 designed as an a.c. or d.c. generator.

Figure 2:
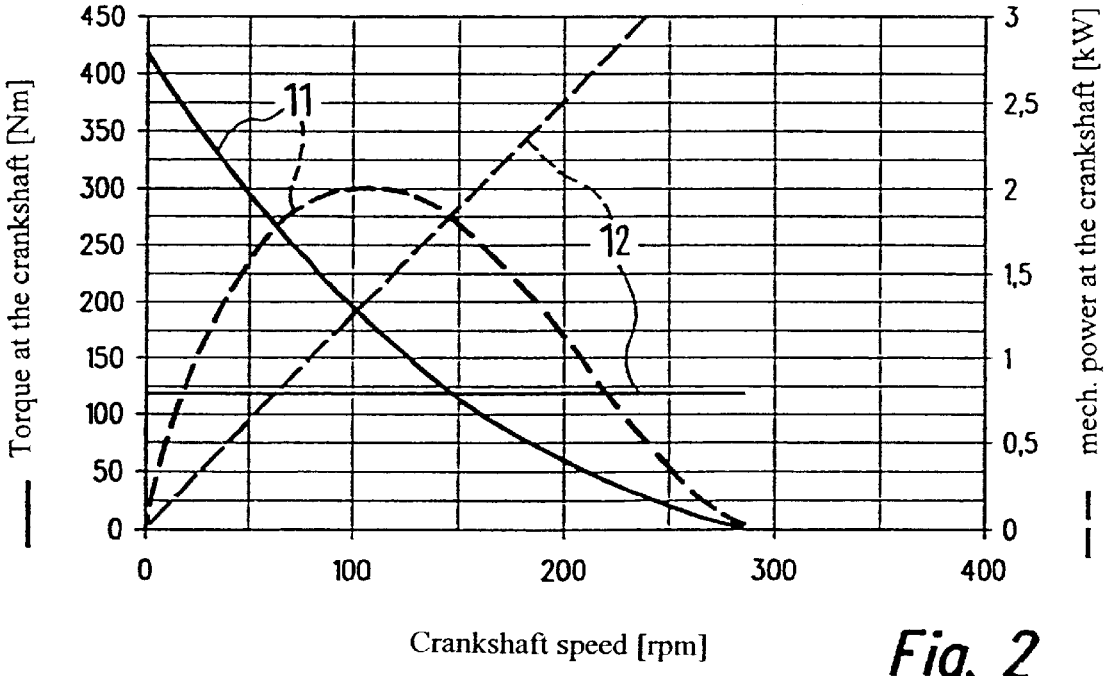

In response to a starting signal from the starter switch 16, the electronic control device 15 activates the starter 11 and connects the semiconductor circuit arrangement 13 as an inverter. As a result, the starter 11 and the generator 12 perform the starting operation of the internal combustion engine 10 jointly. FIG. 2 shows the torques and the mechanical power of the starter 11 and the generator 12 at the crankshaft, the solid lines representing the torques and the broken lines the powers as a function of the crankshaft speed. This illustration shows that the initially high torque of the starter falls rapidly and continuously to vanishingly small values as the rotational speed increases, and the initially increasing power likewise falls below even 300 rpm, to a value of essentially zero. In contrast, the torque of the generator 12 is constant and the power rises in an essentially linear manner. The diagram thus shows that the torque of the active generator cuts in precisely when that of the starter begins to slacken off. The superimposition of the two driving torques takes effect at the crankshaft and accelerates it well beyond the speed that can be achieved nowadays with a starter.

This combined operation is necessary particularly in the case of a cold start and low outside temperatures since the conventional starter 11 has an initially very high driving torque which is effective even at low temperatures.

When the internal combustion engine 10 is warm or the outside temperatures are high, only the electric generator 12 is required for the starting operation. Thus, the semiconductor circuit arrangement 13 is accordingly merely connected as an inverter to provide motor operation of the generator 12.

These two different starting processes, i.e. cold starting and warm starting, are stored as an algorithm in the control device 15 as a function of corresponding sensor signals. For example, a cold start can be defined by the engine-oil temperature and the outside temperature being below a predeterminable value and/or by the off time since the last operation of the internal combustion engine being greater than a predeterminable time period. A warm start is defined engine-oil temperatures and outside temperatures above definable values and/or at off times smaller than a predeterminable time period. It is also possible for the relationship between these sensor variables to be defined by a particular function.

For cold starting, two different starting methods can be implemented. In one starting method, the generator operates as a motor in parallel with the starter 11. In this case, the starter is deactivated at a certain speed and the generator, operating as a motor, accelerates the crankshaft further to the starting speed.

In the second variant, the starter 11 is switched on first and only when a certain speed has been reached is it deactivated and the generator, operated as a motor, is activated. To lower consumption and reduce noxious exhaust gases, no injection and no ignition are carried out until a speed value corresponding, for example, to 80% of the starting speed is reached, and the internal combustion engine 10 is thus only started at this point. This starting operation takes place very rapidly by means of an electronic engine control system (not shown), which can be operatively connected to the electronic control device 15. This delayed onset of ignition and injection also takes place in a corresponding manner in the case of a starting operation solely by means of the generator 12.

Customary starters 11 have a total transmission ratio of about 60:1, this being obtained from the transmission ratio of the starter pinion to the crankshaft and by the intermediate-gear transmission ratio. In the arrangement according to the invention, this transmission ratio can be significantly reduced. That is, the intermediate gear can, for example, be omitted, thus giving a total transmission ratio of 15:1.

Independently of the starting operation, the electronic control device 15 can also control the generator 12 to assist with driving dynamics, for example, while the internal combustion engine 10 is running. In all acceleration operations of the internal combustion engine 10, for example, the generator 12—operated as a motor—can assist these acceleration operations. On the other hand, it can also assist deceleration operations in generator mode, i.e. it is operated as a generator in overrun mode and braking mode, with the result that not only is electric energy recovered, depending on the driving situation, but the deceleration process is also actively assisted.

The electronic control device 15 can furthermore actively assist shift operations during gear changing in the gearbox of the internal combustion engine 10 and be used to synchronize engine and gearbox speeds. To increase the speed, the generator 12 is operated as a motor and to reduce the speed the generator 12 is operated as a generator. This leads to faster gear changes, thereby making it possible to omit even a clutch under certain circumstances.

The electronic control device 15 can furthermore be used to prevent belt slip of the generator 12. A measuring device (not shown) for detecting belt slip transmits its measurement signals to the electronic control device 15, which uses the active generator 12 to couple or decouple or compensate, in a manner which reduces additional torque on the belt. This measurement device for detecting belt slip can also be part of the electronic control device 15, where the speeds of the generator 12 and the internal combustion engine 10 are compared with one another. For belt slip detection, it is possible, for example, for a measurement roller to be resiliently and pivotally connected to the forward strand and the return strand of the drive belt, these measurement rollers detecting the stretching of the drive belt due to different torques. Detection of the belt slip allows preventive belt diagnosis and the risk of a problem with the belt can be communicated to the driver of a motor vehicle at an early stage, e.g. by means of an optical and/or acoustic warning device or a display.

The electronic control device 15 can furthermore be used to position the crankshaft. When the internal combustion engine is switched off, a favourable well-defined initial position is imposed on the crankshaft by the generator 12, which is operated as a motor. For this purpose, the generator is, for example, designed as a fully functional four-quadrant positioning drive. As a result, the next starting operation of the internal combustion engine can be performed from a defined initial position, thereby considerably speeding up the starting operation.

The arrangement according to the invention is also suitable for controlling or influencing the running down of the internal combustion engine 10. Undefined quantities of fuel often remain in the intake system and the cylinders when the internal combustion engine 10 is switched off. The highly volatile components of the fuel evaporate, however, the poorly combustible components do not evaporate. They impair the quality of the exhaust gas when the internal combustion engine is restarted. This problem is circumvented in a refinement of the invention by switching off the fuel supply or fuel injection when the internal combustion engine 10 is switched off. The revolution of the internal combustion engine 10 is maintained for a certain time by the generator 12 in motor mode, thereby flushing the internal combustion engine and harmlessly disposing of fuel residues, which may also be in the catalytic converter. When the internal combustion engine is restarted, the engine control unit or control device 15 can assume that the internal combustion engine is "empty" and this makes a defined start easier.

After flushing and the disposal of the fuel residues, the internal combustion engine 10 can be braked to a halt in a defined manner with the generator 12 in generator mode since a long after-running phase is not desirable.

Another application of the drive arrangement according to the invention is the improvement of the start/stop operations of the internal combustion engine 10, e.g. at traffic lights. Opportunities for implementation increase especially if the internal combustion engine or motor vehicle can be started without delay. Even the slightest delays are viewed by an operator as being extremely irritating. With the aid of the electronic control device 15 in conjunction with the generator 12, it is possible to stop the vehicle without disconnecting the internal combustion engine. Any other torque shocks which occur can be compensated for by the generator in a comfortable manner. Starting is then likewise performed once more without operating a clutch, by "electrical" drive-away, this being possible completely without a delay. This can, of course, also be performed with the internal combustion engine disconnected. In motor operation of the generator 12, purely electrical drive-away may take place with assistance from the starter 11, particularly when the internal combustion engine is cold or temperatures are very low. The starting or connection of the internal combustion engine 10 can then be performed with something of a time delay, in particular in a pulsed manner. Since, during starting of the internal combustion engine, the vehicle is then already in motion, the kinetic energy of the entire vehicle, not just individual parts of the drive line, is involved in starting the internal combustion engine, thus ensuring reliable starting.

Such a start/stop system preferably operates in connection with a road-condition detection system, such as an electronic stabilization system or traction control system.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electric drive system for an internal combustion engine in a motor vehicle having an electric starter for the internal combustion engine, an electric generator in drive connection with the internal combustion and a battery for supplying voltage, said system comprising:

a semiconductor circuit connected to said battery and said generator; and an electronic control device controlling said semiconductor circuit, said electronic control device having a first input for receiving a vehicle start signal, a second input for receiving at least one temperature sensor signal and at least one output for providing a control signal to said electric starter and said semiconductor circuit;

wherein said electronic control device output signal controls on and off operation of said electric starter and controls said semiconductor circuit to effect operation of said generator in either a motor mode or a generator mode;

whereby starting of said internal combustion engine is performed as a function of said generator operating as a motor either alone or together with said electric starter, wherein said electronic control device includes means for switching the generator to operate as a motor, after the internal combustion engine is switched off and the fuel supply is switched off in order to maintain the rotation of the internal combustion engine during a post-operative phase until all residues still contained in the internal combustion engine or in a catalytic converter have been substantially removed.

2. The system according to claim 1, wherein said semiconductor circuit is connected as an inverter for motor operation of the generator, and is connected as a rectifier for operating in a generator mode in which said generator is an a.c. or d.c. generator.

3. The system according to claim 1, wherein the starting operation is controlled as a function of at least one of an engine-oil temperature and the off time of the internal combustion engine.

4. The system according to claim 1, wherein said electronic control device outputs said at least one control signal to start the internal combustion engine by means of the generator and the starter when said at least one temperature input signal is less than a predetermined value, and to start the internal combustion engine by means of the generator alone when said at least one temperature input signal is above said predetermined value.

5. The system according to claim 4, wherein said output control signals from said internal combustion engine function to start the internal combustion engine when said input temperature is below a predetermined value such that the generator and starter are switched-on on one of simultaneously and successively with or without a time overlap.

6. An electric drive system for an internal combustion engine in a motor vehicle having an electric starter for the internal combustion engine, an electric generator in drive connection with the internal combustion and a battery for supplying voltage, said system comprising:

a semiconductor circuit connected to said battery and said generator; and an electronic control device controlling said semiconductor circuit, said electronic control device having a first input for receiving a vehicle start signal, a second input for receiving at least one temperature sensor signal and at least one output for providing a control signal to said electric starter and said semiconductor circuit;

wherein said electronic control device output signal controls on and off operation of said electric starter and controls said semiconductor circuit to effect operation of said generator in either a motor mode or a generator mode;

whereby starting of said internal combustion engine is performed as a function of said generator operating as a motor either alone or together with said electric starter, further including a crankshaft control output from said electronic control device to set a defined angular position of the crankshaft when the internal combustion engine is shut off.

7. An electric drive system for an internal combustion engine in a motor vehicle having an electric starter for the internal combustion engine, an electric generator in drive connection with the internal combustion and a battery for supplying voltage, said system comprising:

a semiconductor circuit connected to said battery and said generator; and an electronic control device controlling said semiconductor circuit, said electronic control device having a first input for receiving a vehicle start signal, a second input for receiving at least one temperature sensor signal and at least one output for providing a control signal to said electric starter and said semiconductor circuit;

wherein said electronic control device output signal controls on and off operation of said electric starter and controls said semiconductor circuit to effect operation of said generator in either a motor mode or a generator mode;

whereby starting of said internal combustion engine is performed as a function of said generator operating as a motor either alone or together with said electric starter, further including means for activating an ignition during the starting operation of the internal combustion engine providing speeds substantially equal to the starting speed.

8. The system according to claim 1, further including means for activating the ignition during the starting operation of the internal combustion engine providing speeds only at speeds which are close to the starting speed, wherein, during operation of the engine, the electronic control device outputs a deceleration signal to switch on the generator in the generator mode and wherein said electronic control device provides an acceleration signal to assist acceleration operation of the internal combustion engine by switching the generator to operation as a motor.

9. The system according to claim 8, wherein the switching-on of the generator in the generator mode is accomplished as a function of the speed of the internal combustion engine.

10. The system according to claim 8, wherein the switching-on of the generator as one of a generator mode or a motor mode is accomplished to provide synchronization of the engine speed and the gearbox speed during gear changing.

11. The system according to one of claim 8, wherein the switching-on of the generator in the generator mode or in the motor mode compensates for different torques at the belt drive of the generator.

12. The system according to claim 1, further including means for switching the generator from operation as a motor to operation as a generator after the post-operative phase.

13. An electric drive system for an internal combustion engine in a motor vehicle having an electric starter for the internal combustion engine, an electric generator in drive connection with the internal combustion and a battery for supplying voltage, said system comprising:

a semiconductor circuit connected to said battery and said generator; and an electronic control device controlling said semiconductor circuit, said electronic control device having a first input for receiving a vehicle start signal, a second input for receiving at least one temperature sensor signal and at least one output for providing a control signal to said electric starter and said semiconductor circuit;

wherein said electronic control device output signal controls on and off operation of said electric starter and controls said semiconductor circuit to effect operation of said generator in either a motor mode or a generator mode;

whereby starting of said internal combustion engine is performed as a function of said generator operating as a motor either alone or together with said electric starter, wherein the electronic control device includes an output for controlling the starting operation of the internal combustion engine for immediate driving away of the motor by operation of the generator in the motor mode.

14. The system according to claim 13, wherein starting of the internal combustion engine is delayed in the case of an electronic driving away of the motor vehicle by means of the generator operated as a motor.

15. An electric drive system for an internal combustion engine in a motor vehicle having an electric starter for the internal combustion engine, an electric generator in drive connection with the internal combustion and a battery for supplying voltage, said system comprising:

a semiconductor circuit connected to said battery and said generator; and an electronic control device controlling said semiconductor circuit, said electronic control device having a first input for receiving a vehicle start signal, a second input for receiving at least one temperature sensor signal and at least one output for providing a control signal to said electric starter and said semiconductor circuit;

wherein said electronic control device output signal controls on and off operation of said electric starter and controls said semiconductor circuit to effect operation of said generator in either a motor mode or a generator mode;

whereby starting of said internal combustion engine is performed as a function of said generator operating as a motor either alone or together with said electric starter, wherein said electronic control device further includes means for controlling the stopping operation of the motor vehicle without disconnecting internal combustion engine by means of the generator.

* * * * *